US010493604B2

(12) United States Patent
Wu

(10) Patent No.: US 10,493,604 B2
(45) Date of Patent: Dec. 3, 2019

(54) TORQUE-ADJUSTING APPARATUS

(71) Applicant: Matatakitoyo Tool Co., Ltd., Taichung (TW)

(72) Inventor: Yi-Min Wu, Taichung (TW)

(73) Assignee: Matatakitoyo Tool Co., Ltd., Taichung (TW)

( * ) Notice: Subject to any disclaimer, the term of this patent is extended or adjusted under 35 U.S.C. 154(b) by 214 days.

(21) Appl. No.: 15/676,973

(22) Filed: Aug. 14, 2017

(65) Prior Publication Data

US 2019/0047126 A1 Feb. 14, 2019

(51) Int. Cl.
*B25B 23/142* (2006.01)

(52) U.S. Cl.
CPC ..... *B25B 23/1427* (2013.01)

(58) Field of Classification Search
CPC ..... B25B 23/1427
USPC ..... 81/475
See application file for complete search history.

(56) References Cited

U.S. PATENT DOCUMENTS 4,280,379 A * 7/1981 Chow ..... B25B 13/465 192/43.1
4,762,032 A * 8/1988 Chow ..... B25B 13/465 81/62
8,757,032 B2 * 6/2014 Shu-Ju ..... B25G 1/063 81/177.8
2011/0113936 A1 * 5/2011 Chiang ..... B25B 23/1427 81/483

* cited by examiner

*Primary Examiner* — Hadi Shakeri

(57) ABSTRACT

A torque tool is provided with a torque-adjusting apparatus that includes a body, a lever and a catch. The body includes a tunnel extending in an axial manner and a slot extending in a radial manner so that the tunnel is in communication with the slot. The catch is formed with teeth and movable between a withdrawn position to locate the teeth in the slot and an extended position to locate the teeth out of the slot. The lever includes a portion pivotally connected to the body and inserted in the tunnel. The lever further includes a rear end connected to the catch and movably inserted in the slot between a lower position to locate the catch in the withdrawn position and an upper position to locate the catch in the extended position.

7 Claims, 9 Drawing Sheets

TORQUE-ADJUSTING APPARATUS

BACKGROUND OF INVENTION

1. Field of Invention

The present invention relates to a torque wrench and, more particularly, to a torque-adjusting apparatus for a torque wrench.

2. Related Prior Art

There are various torque tools such as torque wrenches and torque screwdrivers. A torque wrench or torque screwdriver includes a torque-adjusting apparatus operable to adjust a maximum value of torque to be delivered thereby.

There are various conventional torque-adjusting apparatuses. A conventional torque-adjusting apparatus includes a knob and a controlling ring. The knob includes teeth formed on the periphery. The controlling ring includes teeth formed on an internal face. The knob is not rotatable relative to the controlling ring when the teeth of the former are engaged with that of the latter.

The knob is rotatable relative to the controlling ring to adjust the maximum value of torque when the former is moved axially relative to the latter to disengage the teeth of the former from that of the latter. Then, the knob is moved back to the original position relative to the controlling ring to engage the teeth of the former with that of the latter to render the knob non-rotatable relative to the controlling ring.

The knob is equipped with a ball and a spring. The spring is inserted in the knob. The ball is at least partially inserted in the knob. A portion of the ball is pressed by the spring so that another portion of the ball tends to extend from the knob. The ball is pressed by the controlling ring when the knob is inserted in the controlling ring so that the ball is hindered by the ball. However, the ball could easily escape from the knob when the knob is moved from the controlling ring. The torque-adjusting apparatus could malfunction when this happens.

Torque-adjusting apparatuses with the above-mentioned structure can be found in Taiwanese Patent Nos. M371616 and I541108. However, there is always room for improvement.

The present invention is therefore intended to obviate or at least alleviate the problems encountered in prior art.

SUMMARY OF INVENTION

It is the primary objective of the present invention to provide a relatively efficient, simple and inexpensive torque-adjusting apparatus.

To achieve the foregoing objective, the torque-adjusting apparatus includes a body, a lever and a catch. The body includes a tunnel extending in an axial manner and a slot extending in a radial manner so that the tunnel is in communication with the slot. The catch is formed with teeth and movable between a withdrawn position to locate the teeth in the slot and an extended position to locate the teeth out of the slot. The lever includes a portion pivotally connected to the body and inserted in the tunnel. The lever further includes a rear end connected to the catch and movably inserted in the slot between a lower position to locate the catch in the withdrawn position and an upper position to locate the catch in the extended position.

The torque tool further includes a handle, a rod and a sleeve. The handle is located around the body. The rod is rotationally inserted in the handle and adapted for adjusting a maximum value of torque to be delivered by the torque tool. The rod is inserted in and connected to the tubular portion so that they are rotatable together. The sleeve is non-rotationally inserted in the handle. The sleeve includes teeth on an internal face around the rod. The catch includes teeth engaged with the teeth of the sleeve to prevent rotation of the body relative to the handle when the catch is in the extended position. The teeth of the catch are disengaged from the teeth of the sleeve when the catch is in the withdrawn position.

Advantageously, the torque-adjusting apparatus includes only one catch movable between the withdrawn position to allow the adjustment of the maximum value of torque and the extended position to prevent the adjustment of the maximum value of torque. Hence, the structure of the torque-adjusting apparatus is simple, and the cost is low.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
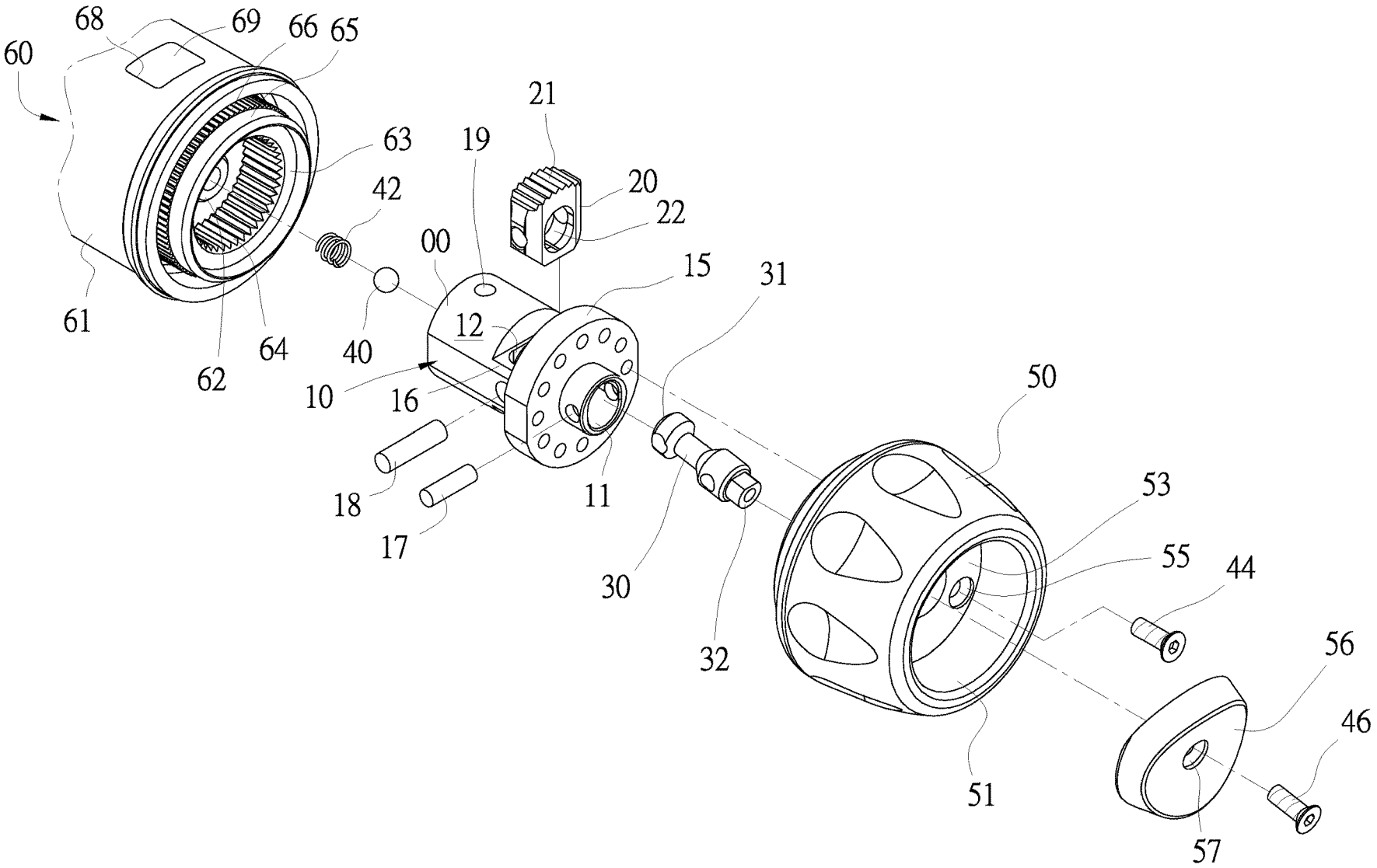
FIG. 1 is an exploded view of a torque tool including a torque-adjusting apparatus according to the preferred embodiment of the present invention.
Figure 2:
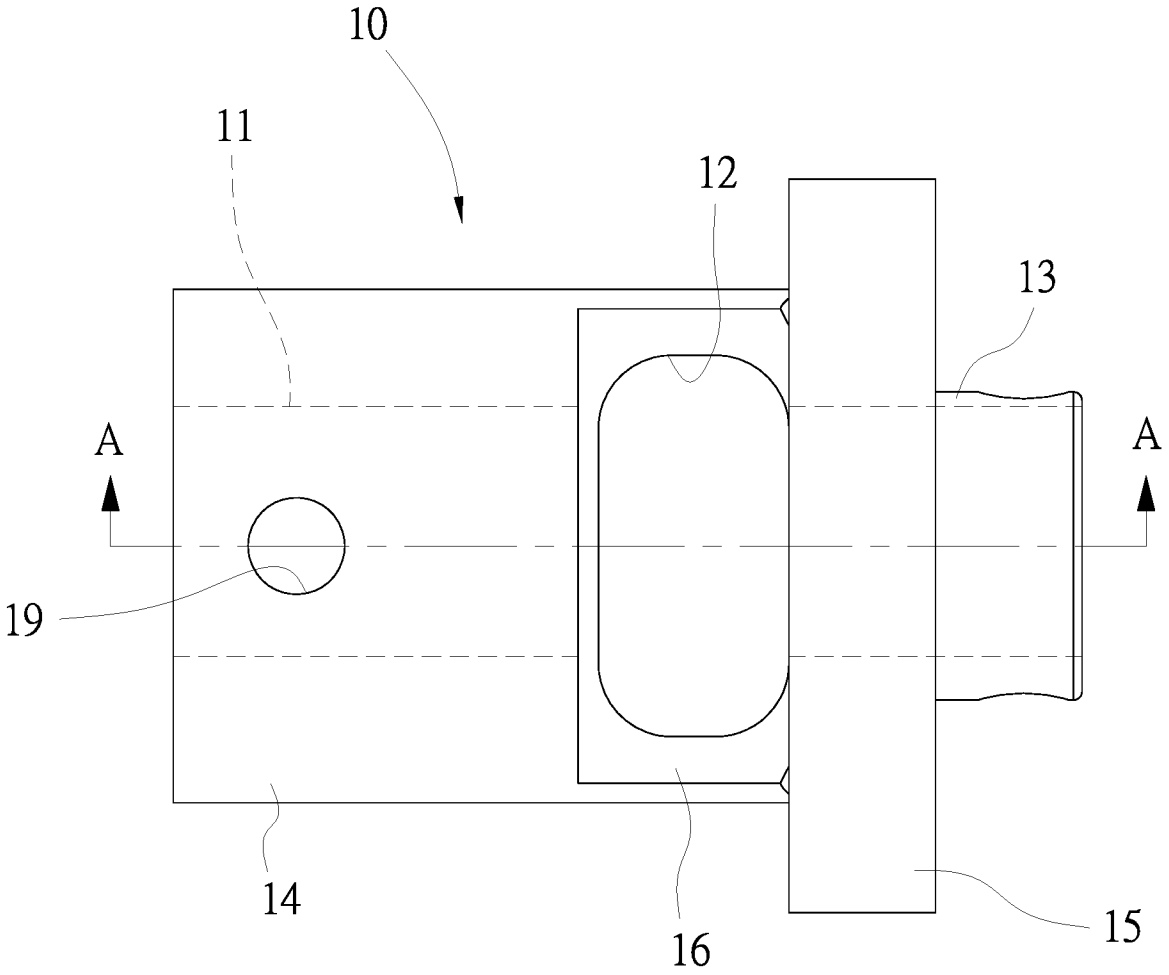
FIG. 2 is a side view of the torque-adjusting apparatus shown in FIG. 1.
Figure 3:
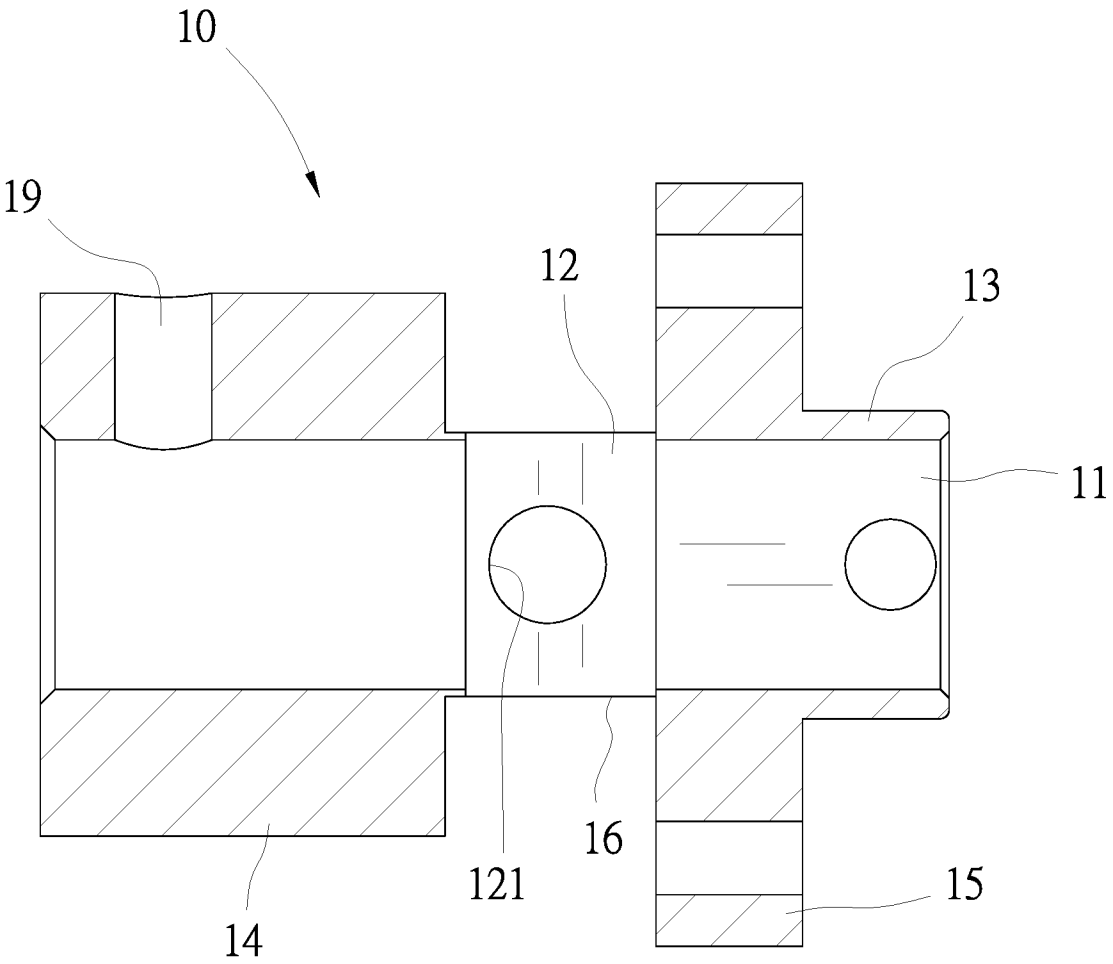
FIG. 3 is a cross-sectional view of the torque-adjusting apparatus taken along a line A-A shown in FIG. 2.

Partially shown in FIG. 1 is a torque tool 60 that includes a torque-adjusting apparatus according to the preferred embodiment of the present invention. For example, the torque tool 60 is a torque wrench with a head (not shown) for engagement with a nut or a portion of a threaded bolt so that the torque tool 60 is operable to drive the nut or threaded bolt. The torque tool 60 can be a screwdriver or the like in another embodiment.

Figure 4:
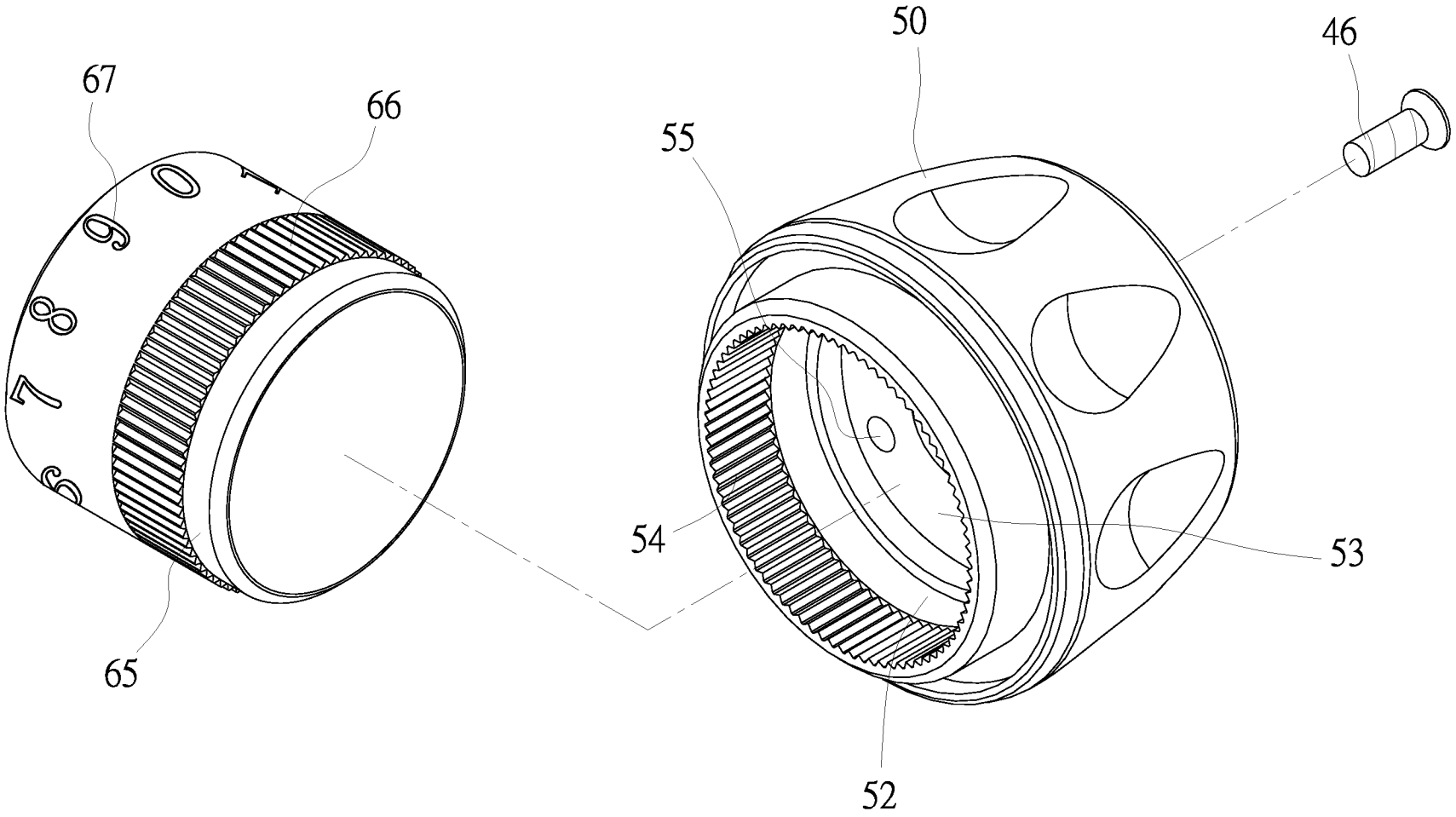
FIG. 4 is an enlarged exploded view of the torque-adjusting apparatus shown in FIG. 1.
Figure 5:
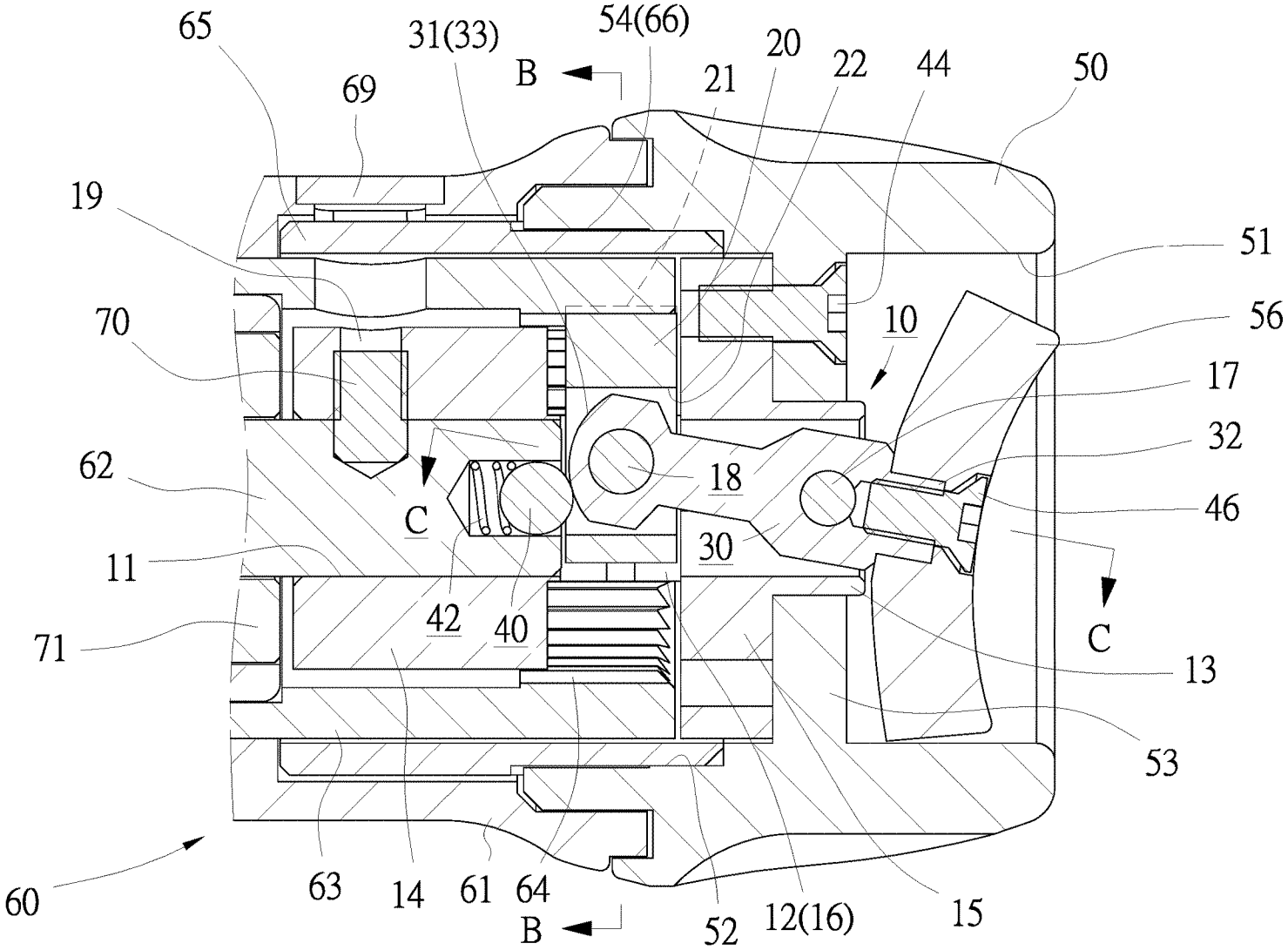
FIG. 5 is another cross-sectional view of the torque-adjusting apparatus shown in FIG. 2.

Referring to FIGS. 1, 4 and 5, the torque tool 60 includes a hollow handle 61, a rod 62, a sleeve 63 and a scale ring 65. The rod 62 is inserted in the handle 61 and supported on a bearing 71 that is also inserted in the handle 61. Thus, the rod 62 is kept rotatable in the handle 61. The sleeve 63 includes teeth 64 formed on an internal face thereof. The teeth 64 of the sleeve 63 are located around the rod 62 when the sleeve 63 is inserted in the handle 61 in a non-movable manner. The scale ring 65 is located on and around the sleeve 63 and inserted in the handle 61 so that the scale ring 65 is rotatable between the sleeve 63 and the handle 61. The scale ring 65 is observable through a window 68 made in the handle 61. A lens 69 is preferably inserted in the window 68 of the handle 61, thereby allowing observation of the scale ring 65 but preventing access to the scale ring 65. The scale ring 65 includes on an external face teeth 66 and a scale 67. The scale 67 includes numbers. At least one of the numbers can be observed through the window 68 to provide a reading of a maximum value of torque to be delivered by the torque tool 60.

The other parts of the torque tool 60 can be found in Taiwanese Patent No. I541108 and hence will not be described. The following specification will be given to the torque-adjusting apparatus.

From FIGS. 1 through 5, it should easily be understood that the torque-adjusting apparatus is operable to adjust the maximum value of torque to be delivered by the torque tool 60. The torque-adjusting apparatus includes a hollow body 10, a catch 20, a lever 30, a ball 40, a spring 42, a knob 50 and a button 56.

The body 10 includes two open ends. A tunnel 11 extends to one of the open ends of the body 10 from the other end of the same. The body 10 further includes a slot 12. The depth of the slot 12 extends along a radius of the body 10. The depth of the tunnel 11 extends along an axis of the body 10. Hence, the depth of the slot 12 extends perpendicular to that of the tunnel 11. The tunnel 11 is in communication with the slot 12.

On the outside, the body 10 includes, between the open ends, an extensive portion 13, a tubular portion 14, an annular flange 15 and a reduced flat portion 16. The extensive portion 13 is located at one of the open end of the body 10 while the tubular portion 14 is located at the other open end of the body 10. The annular flange 15 is located next to the flat portion 16. The flat portion 16 is located between the tubular portion 14 and the annular flange 15. The annular flange 15 is located between the flat portion 16 and the extensive portion 13. The flat portion 16 is made of thickness that is measured in a transverse sense of direction of the body 10 is smaller than the diameter of the extensive portion 13 of that of the tubular portion 14. The slot 12 is made in the flat portion 16. Two apertures 121 are made in the flat portion 16 so that both of the apertures 121 are in communication with the slot 12.

The catch 20 includes teeth 21 formed on an upper face and an aperture 22 made in a central portion. The aperture 22 is aligned to the tunnel 11 when the catch 20 is inserted in the slot 12. Now, the catch 20 is retained in the flat portion 16 that extends around the slot 12. The catch 20 is movable along a diameter of the body 10 between a withdrawn position and an extended position. That is, the catch 20 is rectilinearly reciprocated relative to the body 10.

The lever 30 includes a rear end 31, a front end 32 located opposite to the rear end 31, and a convex face 33 formed at the rear end 31. The rear end 31 of the lever 30 is inserted in the slot 12 via the tunnel 11. The rear end 31 of the lever 30 is further inserted in the aperture 22. Now, a pivot 17 is inserted in a portion of the lever 30 through the extensive portion 13 of the body 10. The front end 32 of the lever 30 extends beyond the extensive portion 13 of the body 10. The lever 30 is connected to the body 10 via a pivot 17, thereby rendering the lever 30 pivotal in the body 10 like a pendulum. Moreover, a pin 18 is inserted in the slot 12 via one of the apertures 121. The pin 18 includes a middle portion inserted in a portion of the lever 30 near the rear end 31 and two terminal sections inserted in the catch 20.

Figure 7:
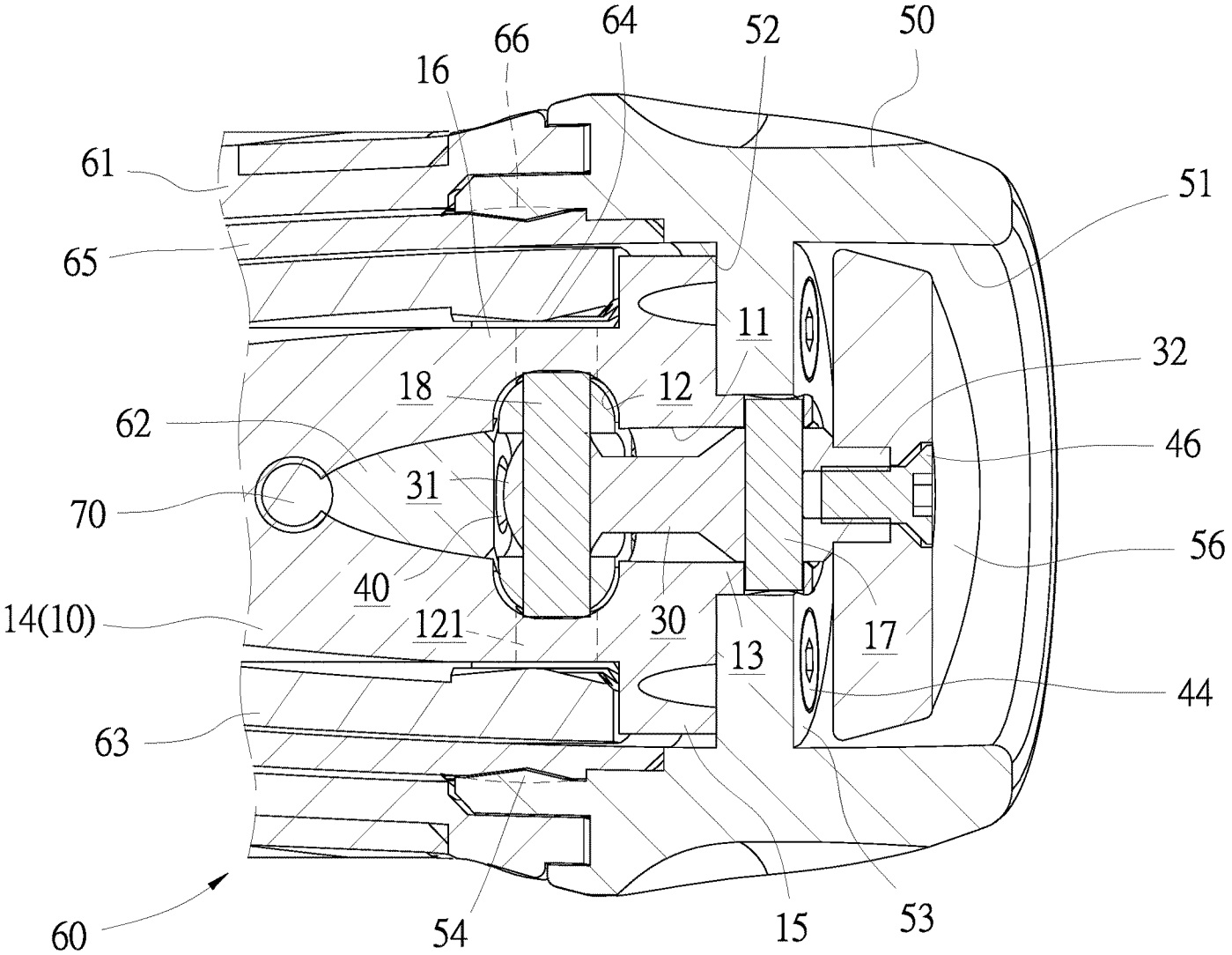
FIG. 7 is a cross-sectional view of the torque-adjusting apparatus taken along a line C-C shown in FIG. 2.

Referring to FIG. 7, the pin 18 is made with length smaller than the width of the slot 12 so that the pin 18 is entirely located out of the apertures 121. Hence, the catch 20, which is connected to the rear end 31 of the lever 30, is allowed to move relative to the body 10. That is, the lever 30 is allowed to pivot about the pivot 17 in the body 10 without any interference from the flat portion 16 or any other portion of the body 10.

The knob 50 is a hollow element that includes an anti-skid external face to facilitate maneuver thereof. The knob 50 further includes an annular rib 53 formed on an internal face, thereby dividing the interior of the knob 50 into a front cavity 51 and a rear cavity 52. The front cavity 51 is in communication with the rear cavity 52 through an aperture in the annular rib 53. The knob 50 further includes teeth 54 formed on the internal face and apertures 55 made in the annular rib 53. Screws 44 are inserted in the annular flange 15 through the apertures 55, thereby connecting the body 10 to the knob 50.

The button 56 includes an aperture 57. A screw 46 is inserted in the front end 32 of the lever 30 via the aperture 57 when the button 56 is inserted in the front cavity 51 of the knob 50 to connect the lever 30 to the button 56. Hence, the button 56 can be pivoted relative to the knob 50 like a switch.

Figure 6:
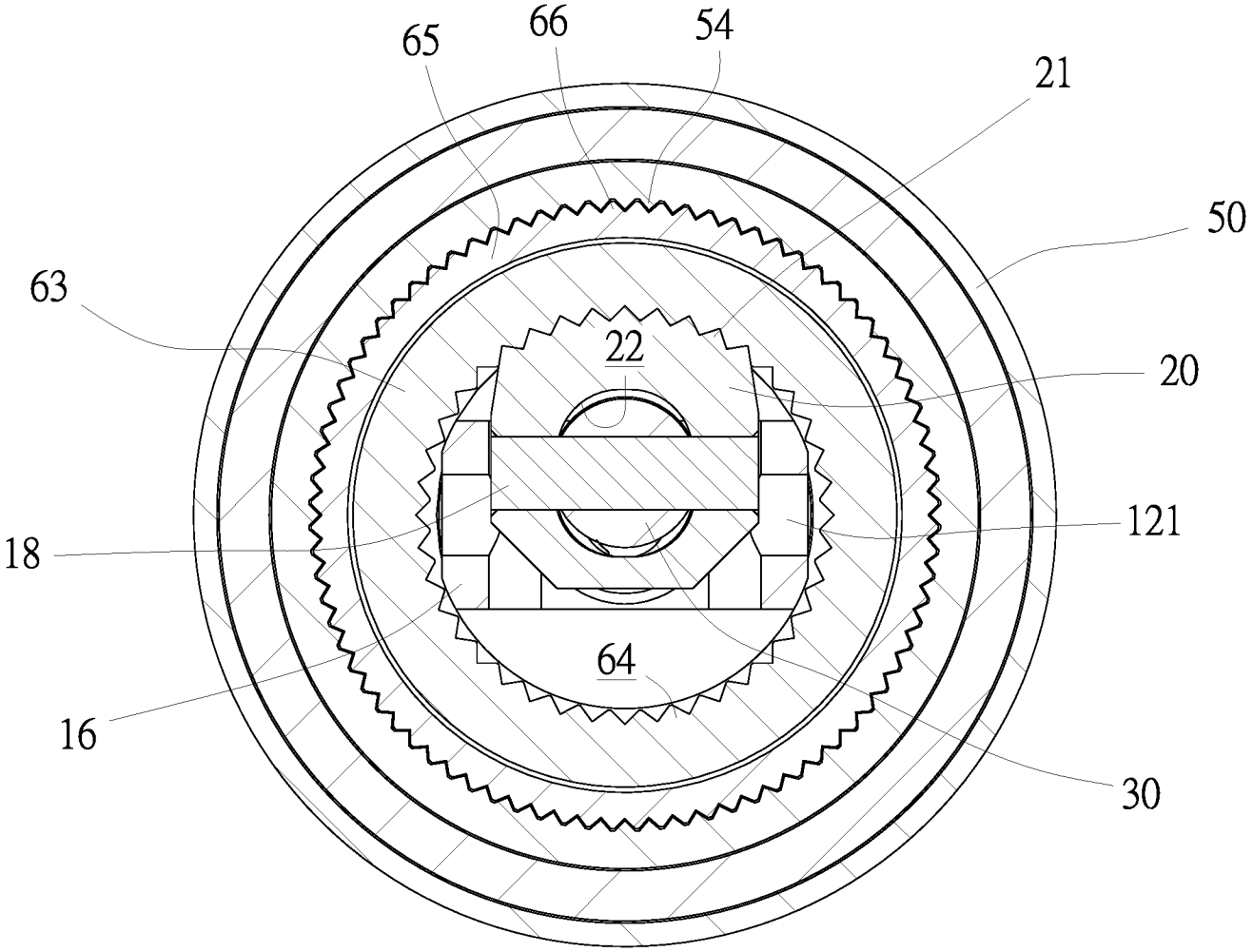
FIG. 6 is a cross-sectional view of the torque-adjusting apparatus taken along a line B-B shown in FIG. 2.

Referring to FIGS. 5 through 7, the connection of the torque-adjusting apparatus to the torque tool 60 will be described.

The body 10 is inserted in the handle 61, with the annular flange 15 placed against the sleeve 63. The tubular portion 14 of the body is located on and around a portion of the rod 62. A pin 70 is inserted in the rod 62 through an aperture 19 made in the tubular portion 14 of the body 10, thereby keeping the body 10 on the rod 62 and rendering the body 10 rotatable together with the rod 62.

Moreover, the spring 42 is inserted in a cavity (not numbered) made in a front end of the rod 62. The spring 42 is compressed between the front end of the rod 62 and the ball 40. The ball 40 is pushed by the rear end 31 of the lever 30. The convex face 33 includes a central portion that extends longer than peripheral portions. The ball 40 tends to keep the lever 30 in a position when the ball 40 is abutted against a peripheral portion of the convex face 33. Hence, the button 46, which is connected to the lever 30, is kept in a position relative to the body 10.

The catch 20 is in the extended position. The catch 20 is in an upper position while the button 56 is in a lower position since they are connected to each other via the lever 30. A portion of the catch 20 is located out of the slot 12 of the body 10. Accordingly, the teeth 21 are in an upper position relative to the body 10, thereby engaging the teeth 21 with the teeth 64 of the sleeve 63.

Now, the sleeve 63 is not movable so that the body 10 and the knob 50 are movable. The knob 50 cannot be maneuvered by mistake even if the torque tool 60 is used to loosen or tighten a nut or a threaded bolt. That is, the maximum value of torque delivered by the torque tool 60 cannot be adjusted by mistake.

Figure 8:
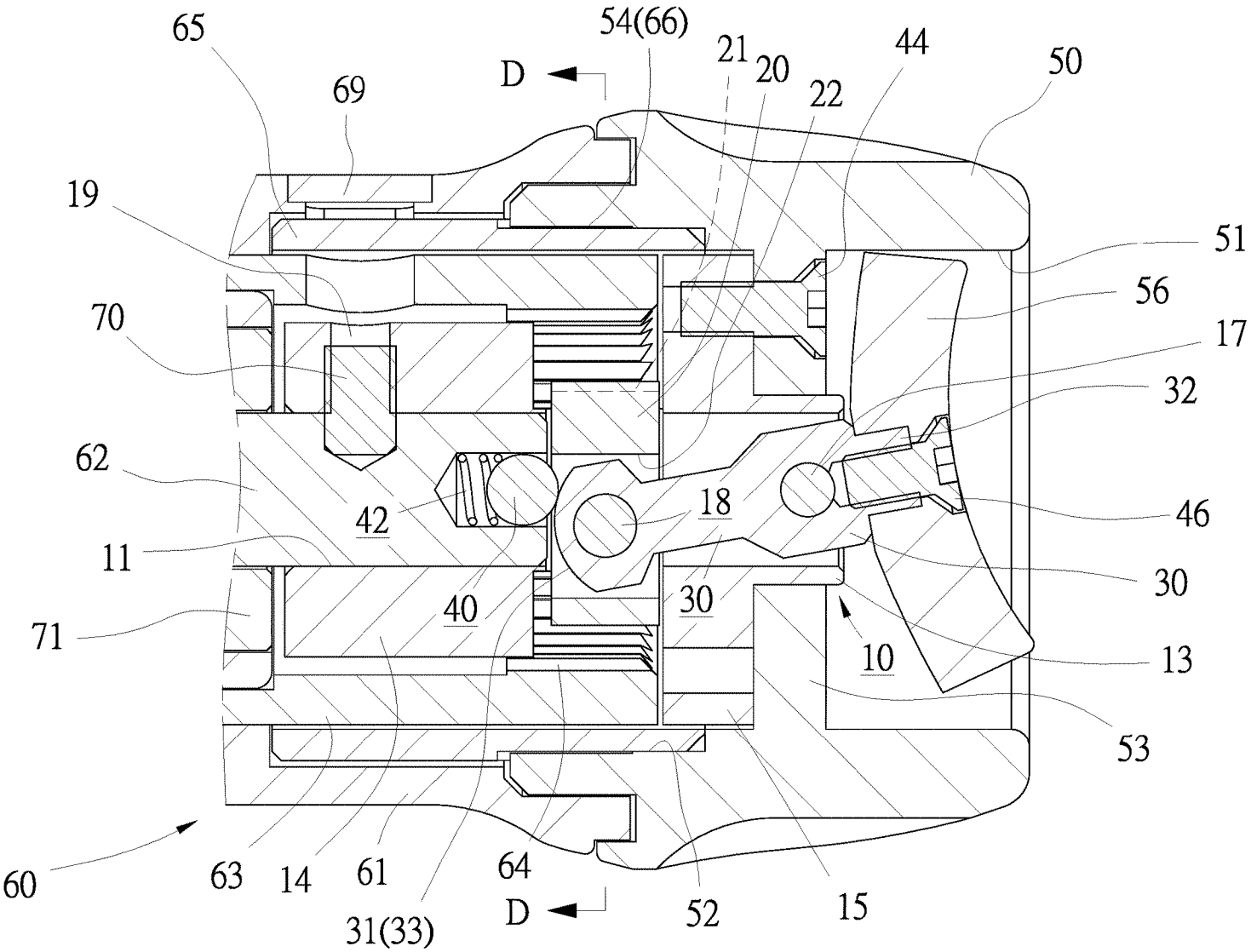
FIG. 8 is a cross-sectional view of the torque-adjusting apparatus in another position than shown in FIG. 5.
Figure 9:
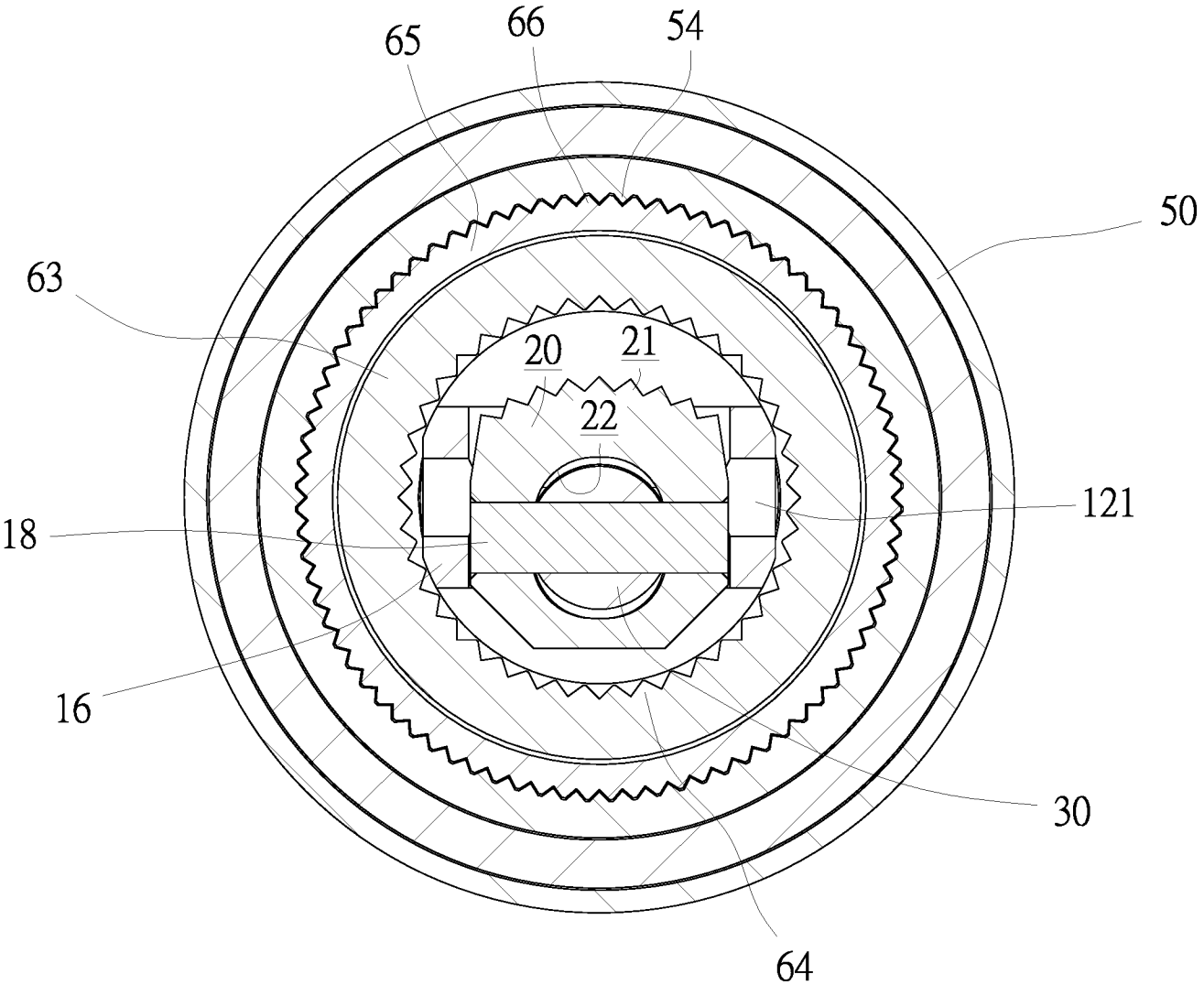
FIG. 9 is a cross-sectional view of the torque-adjusting apparatus taken along a line D-D shown in FIG. 8.

Referring to FIGS. 8 and 9, the catch 20 is in the withdrawn position. The catch 20 is in a lower position while the button 56 is in an upper position. The catch 20 is substantially inserted in the slot 12 of the body 10. Accordingly, the teeth 21 are in a lower position relative to the body 10, thereby disengaging the teeth 21 from the teeth 64 of the sleeve 63.

Now, the knob 50 is rotatable relative to the handle 61. The rod 62 is rotatable by the knob 50 via the body 10 because the annular rib 53 of the knob 50 is connected to the annular flange 15 of the body 10 and the rod 62 is connected to the tubular portion 14 of the body 10. Hence, the maximum value of torque delivered by the torque tool 60 can be adjusted by rotating the knob 50.

Moreover, the scale ring 65 is partially inserted in the rear cavity 52 of the knob 50, allowing engagement of the teeth 66 with the teeth 54. Hence, the scale ring 65 is rotatable together with the knob 50. The scale 67 of the scale ring 65 is observable via the lens 69 fitted in the window 68 (FIG. 4), and a reading of the maximum value of torque to be delivered by the torque tool 60 is easily obtainable.

The button 56 can be moved downward to bring the catch 20 to the extended position from the withdrawn position again. The maximum value of torque to be delivered by the torque tool 60 is hence retained again.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A torque-adjusting apparatus comprising:

a body comprising:

a tunnel extending throughout the body in an axial manner;

an extensive portion near an end;

a tubular portion near an opposite end;

an annular flange near the extensive portion; and a flat portion between the tubular portion and the annular flange; and a slot in the flat portion in a radial manner so that the slot is in communication with the tunnel;

a catch formed with teeth and movable between a withdrawn position to locate the teeth in the slot and an extended position to locate the teeth out of the slot; and a lever comprising:

a portion inserted in a section of the tunnel in the extensive portion and the annular flange and pivotally connected to the extensive portion; and a rear end connected to the catch and movably inserted in the slot between a lower position to locate the catch in the withdrawn position and an upper position to locate the catch in the extended position.

2. The torque-adjusting apparatus according to claim 1, further comprising a pivot inserted in the extensive portion of the body and a portion of the lever near a front end.

3. The torque-adjusting apparatus according to claim 1, wherein the catch comprises an aperture for receiving the rear end of the lever.

4. The torque-adjusting apparatus according to claim 3, further comprising a pin inserted in the catch and a portion of the lever near the rear end.

5. A torque tool comprising:

a torque-adjusting apparatus comprising:

a body comprising a tunnel extending in an axial manner and a slot extending in a radial manner so that the tunnel is in communication with the slot;

a catch comprising teeth, and movable between a withdrawn position to locate the teeth in the slot and an extended position to locate the teeth out of the slot;

a lever comprising a portion pivotally connected to the body and inserted in the tunnel and a rear end connected to the catch and movably inserted in the slot between a lower position to locate the catch in the withdrawn position and an upper position to locate the catch in the extended position;

a handle located around the body;

a rod rotationally inserted in the handle, wherein the rod is inserted in and connected to the tubular portion so that they are rotatable together;

a sleeve non-rotationally inserted in the handle, wherein the sleeve comprises teeth formed on an internal face around the rod, wherein the catch comprises teeth engaged with the teeth of the sleeve to prevent rotation of the body relative to the handle when the catch is in the extended position, wherein the teeth of the catch are disengaged from the teeth of the sleeve when the catch is in the withdrawn position.

6. The torque tool according to claim 5, wherein the torque-adjusting apparatus further comprises:

a spring abutted against the rod; and a ball biased toward the rear end of the lever by the spring, thereby keeping the rear end of the lever in a selected one of the upper and lower positions.

7. The torque tool according to claim 6, wherein the lever comprises a convex face at the rear end thereof, wherein the ball is located in a lower peripheral portion of the convex face to keep the rear end of the lever in upper position, wherein the ball is located in an upper peripheral portion of the convex face to keep the rear end of the lever in the lower position.

* * * * *